US005092657A

United States Patent [19]

Bryan, Jr.

[11] Patent Number: 5,092,657

[45] Date of Patent: Mar. 3, 1992

[54] STRATUM BOUNDARY SENSOR FOR CONTINUOUS EXCAVATORS

[76] Inventor: John F. Bryan, Jr., 4250 W. Lovers Lane, Dallas, Tex. 75209

[21] Appl. No.: 507,236

[22] Filed: Apr. 10, 1990

[51] Int. Cl.[5] ..... E21C 39/00; E02F 3/20

[52] U.S. Cl. ..... 299/1.1; 37/189; 37/DIG. 1; 299/39

[58] Field of Search ..... 299/1, 30, 39; 37/91, 37/189, DIG. 1, DIG. 18, 195

[56] References Cited

U.S. PATENT DOCUMENTS

| | | | |
|---|---|---|---|
| 2,620,386 | 12/1952 | Alspaugh et al. | 299/1 X |
| 2,790,968 | 4/1957 | Cook et al. | 299/1 X |
| 3,015,477 | 1/1962 | Persson et al. | 299/1 |
| 4,189,183 | 2/1980 | Borowski | 299/1 |

FOREIGN PATENT DOCUMENTS

| | | | |
|---|---|---|---|
| 1265312 | 10/1986 | U.S.S.R. | 299/1 |

*Primary Examiner*—David J. Bagnell
*Attorney, Agent, or Firm*—John F. Bryan, Jr.

[57] ABSTRACT

Probes attached to the moldboard blade penetrate in situ formations while digging with a continuous excavator, thus enabling the direct and simultaneous sensing of characteristic strata property data signals both above and below the digging depth of the excavator. The data signals are evaluated to provide a reference for control of the digging depth so that product contamination by parting material can be minimized while mining, as well as the loss of product while removing the parting material.

20 Claims, 4 Drawing Sheets

STRATUM BOUNDARY SENSOR FOR CONTINUOUS EXCAVATORS

TECHNICAL FIELD

This invention pertains to apparatus for continously sensing the strata boundary of mined product and parting material during the mining process so that the cutting depth of a continuous excavator may be controlled relative thereto. Characteristic properties of the strata are sensed by probes which penetrate the materials in situ to determine the boundary location. Contamination of the product by parting material is thus minimized while mining, and the loss of product is minimized while removing the parting material.

BACKGROUND AND SUMMAY OF THE INVENTION

This invention pertains to the control of the cutting depth for continuous excavators of the general type shown in Satterwhite U.S. Pat. Nos. 3,896,571 or 3,974,580 or any continuous excavator having excavating means mounted on a structural support at the leading end of the machine. The excavating means has two or more sections which are mounted on either side of extended frame members, making it wider than the undercarriage of the excavator. Such machines have the capability of passing through a trench under excavation and advancing along its bottom so that the bottom of the cut is not visible to the operator. Closely following the excavating means on the main frame is a separately mounted moldboard/skid plate assembly. The entire machine is supported on a crawler track or rubber tired undercarriage which can be raised or lowered relative to the digging wheel to adjust its cutting depth. The moldboard blade breaks up uncut material left between the excavating means sections and scrapes the bottom of the cut clean, crowding excess materials forward. The excavating means, which works in an undercutting manner, takes these materials, along with the freshly dug material, to be discharged onto a conveyor.

Mining, and most particularly open pit mining such as for coal, typically finds the product in stratified deposits separated by "parting materials" such as clay or shale. The product can be mined in situ and loaded by a continuous excavator if contamination of the product by parting material can be minimized while mining. The parting materials may be removed by the same excavator if it can be done with minimal loss of product. Both operations have been controlled heretofore by regulation of the digging depth according to the color of the excavated material being discharged. This method is approximate at best and demands close attention by the operator.

It is notable that the parting materials in general have a lower resistivity than lignite and a higher resistivity than anthracite coals. Generally, but not necessarily, parting materials are also harder, having a higher compressive strength than either lignite or coal. The hardness, brittleness and abrasive properties of each material in combination produce a distinctive bit vibration and sound as the formation is penetrated. Most significantly, as we dig through the strata, all of these properties change with each material change. The resistivity characteristic is widely used for wireline logging of boreholes to determine the thickness and content of strata for mine evaluation and planning.

The resistivity and compressive strength values shown below may vary for the cited materials, and materials other than these may be present in a given mine however, every material encountered will have a characteristic value.

TABLE OF TYPICAL PROPERTY VALUES FOR VARIOUS MINE MATERIALS

| MATERIAL | COMPRESSIVE STR. lb./sq. in. | RESISTIVITY ohms/sq. cm/cm |
|---|---|---|
| lignite | 800 | 400,000 |
| anthracite | 3,000 | 100 |
| shale | 6,000 | 5,000 |
| combustible shale | 4,000 | 1,500 |
| sandstone | 13,000 | 80,000 |
| clay | 100 | 1,500 |
| marl | 250 | 50,000 |
| siltstone | 7,500 | 20,000 |
| limestone | 8,000 | 40,000 |

In the present invention, either tabulated property of the mined product and parting materials may be selected as a control index, comparing the measured values of the in situ material contacted by the probes to the known values for the strata. Other properties, such as dielectric strength, vibration or sound may be used as a control variable, but resistivity and compressive strength are readily measured. Resistivity, in particular, can be related directly to logging data.

An object of the present invention is to sense the location of the strata boundary of mined product and parting material relative to the cutting plane in a reliable and durable manner while excavating. A second object is to aquire this sense of the strata boundary location in a form usable for accurate control of the cutting depth of a continuous excavator.

In the present invention, probes penetrating the virgin formation enable direct measurement of material properties for the purpose of sensing stratum boundries. Copending Bryan patent application No. 07/522,467 teaches the use of a moldboard/skid plate assembly which is inherently positioned to follow the digging depth of a forwardly mounted excavating means, facilitating the use of the moldboard as a reference location for mounting such probes. Thus, the contact velocity of the probes is the forward travel rate of the excavator.

The previously mentioned Satterwhite type excavators, with their ability to travel on the floor of the trench, leave standing on the floor an undisturbed portion of the formation which passes between the digging wheel sections. This allows moldboard mounted probes to be positioned to penetrate virgin material that is above as well as below the nominal floor level.

DETAILED DESCRIPTION OF THE INVENTION

While the present invention is capable of application to a variety of excavating machine designs, it is particularly suited to those adapted for control of the excavated grade in accordance with copending Bryan patent application Ser. No. 07/522,467, however, the invention is not so limited and can be used on any suitable excavator application where strata interface sensing is required.

Figure 1:
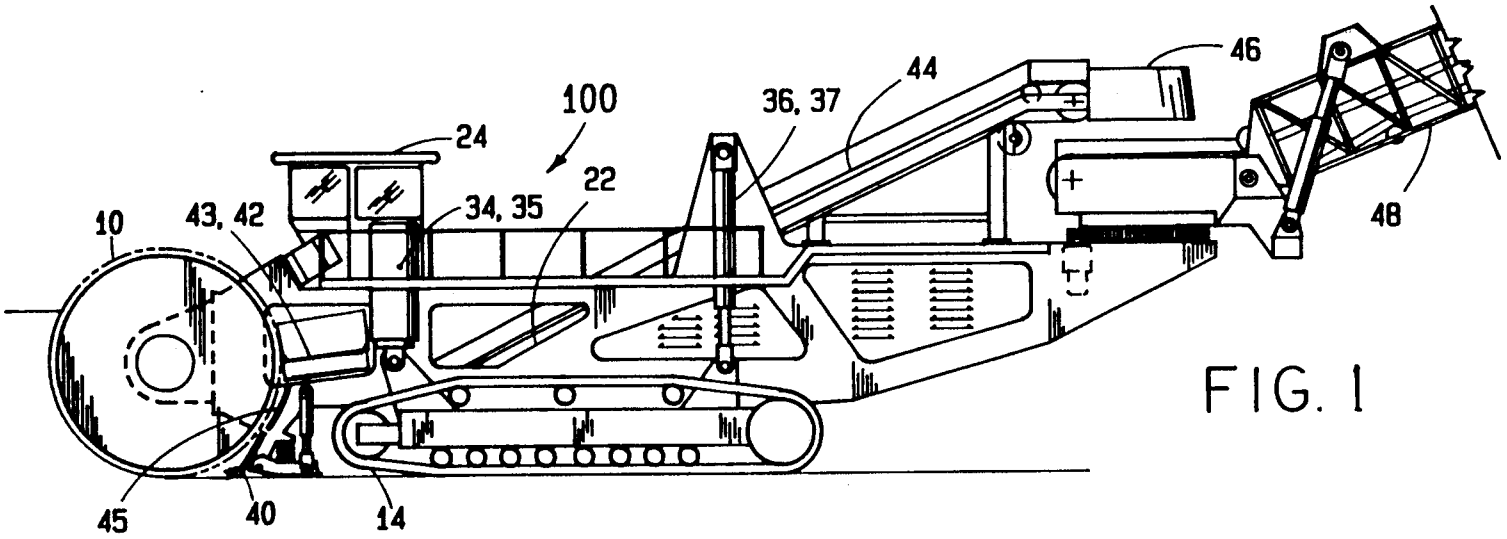
FIG. 1 is a side view of a track mounted bucket wheel type excavator utilizing the present invention.

A preferred embodiment of the present invention is used with a continuous excavator as shown in FIG. 1. The excavator 100 has a vehicle main frame 22 with an operator cab 24 mounted thereon and a digging wheel 10, rotating in a clockwise or undercutting sense as shown by arrow R, mounted to the front end thereof. The digging wheel 10 is made in portions that straddle extensions of the frame 22. The excavator 100 is supported on an undercarriage 14, which is attached to the main frame 22 for vertical movement by means of right and left front hydraulic cylinders 34 and 35 and right and left rear hydraulic cylinders 36 and 37. A moldboard and skid plate assembly 40, incorporating the present invention, is mounted to the main frame 22 immediately behind the digging wheel 10 to clean the floor of the excavation.

Lateral conveyors 42 and 43 are mounted adjacent the digging wheel 10 to receive material discharged from the outer portions thereof for transfer to the central main conveyor 44. Any shortfall is directed by the crumbing plate 45 so that it falls in front of the moldboard and skid plate assembly 40 and is recirculated. The discharged material is carried by the main conveyor 44 to the chute 46 at the rear of the machine where it is transferred to the slewing load conveyor 48 which off-loads the material as required by a given application.

FIGS. 2 through 5 show how, in the invention, lower probe means 52 are fixed to the moldboard blade 60 so as to penetrate slightly below the plane 70 cut by blade edge 60 into the underlying material 92 as material 90 is excavated. Similar upper probe means 54 are positioned in the gaps between the digging wheel 10 portions, where they are placed slightly above the surface 70 cut by digging wheel 10 and the moldboard blade 60 and sufficiently in advance of the moldboard blade 60 so as to contact undisturbed material 90' (unshown in FIG. 2), left between portions of digging wheel 10.

Figure 2:
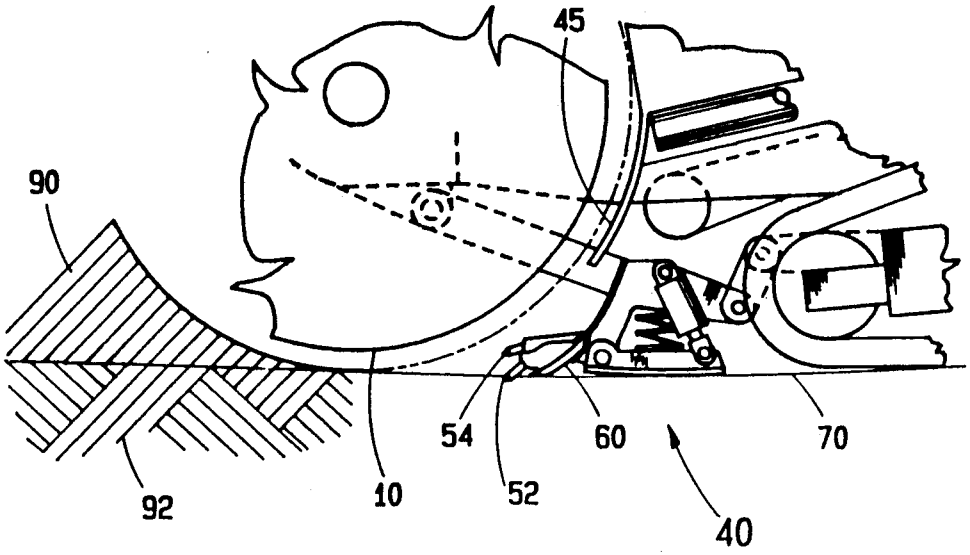
FIG. 2 is a detailed side view of the moldboard/skid plate assembly of FIG. 1 showing a preferred embodiment of the present invention.
Figure 3:
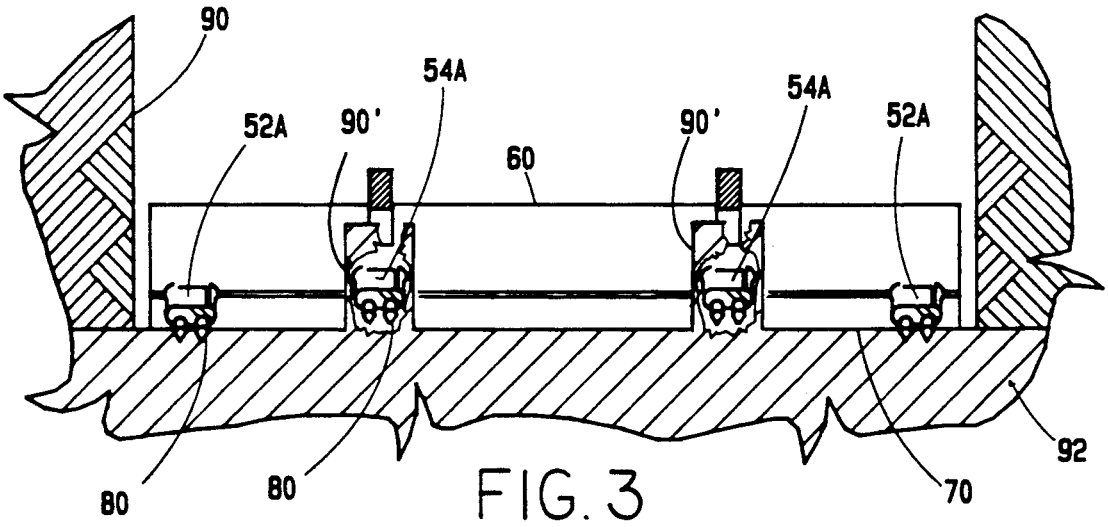
FIG. 3 is a detailed front view of the moldboard/skid plate assembly of FIG. 1 showing a preferred embodiment of the present invention.
Figure 4:
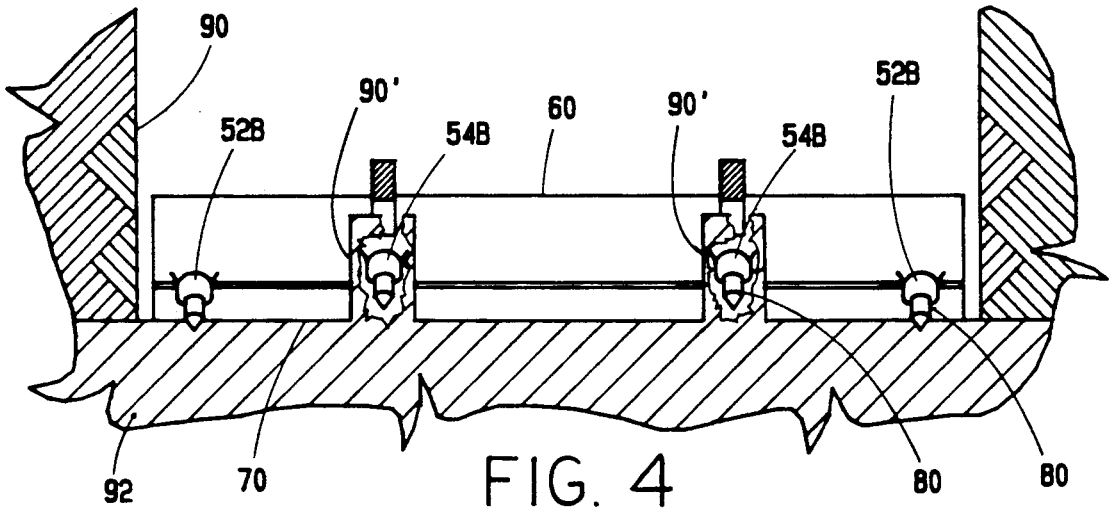
FIG. 4 is a detailed front view of the moldboard/skid plate assembly of FIG. 1 showing a second embodiment of the present invention.
Figure 5:
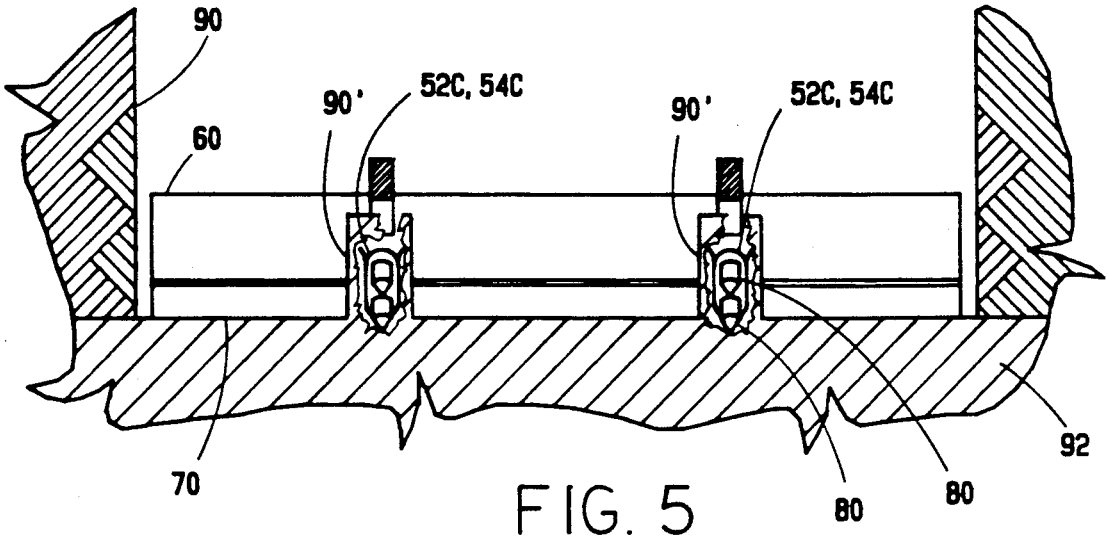
FIG. 5 is a detailed front view of the moldboard/skid plate assembly of FIG. 1 showing a third embodiment of the present invention.

FIGS. 3, 4 and 5 show alternate embodiments of the probe means of FIG. 2. In FIG. 3, lower probe means 52A are shown to comprise closely spaced pairs of probe inserts 80 near each outboard end of moldboard blade 60. Upper probe means 54A are shown to comprise similar pairs of probe inserts 80 located on that portion of moldboard blade 60 that contacts the undisturbed material 90'. Pairing of the inserts 80 in this manner is most suitable for determination of electrical properties of a stratum such as resistivity or capacitivity since readings can be taken across a stable fixed dimension. It also is useful for the other property measurements in that more data signals allow averaging for enhanced reliability.

FIG. 4 shows a second alternate arrangement wherein upper and lower probe means 54B and 52B are shown to comprise single probe inserts 80, with the locations on the moldboard blade 60 as in FIG. 3. This arrangement is less suited to measurement of the electrical properties of the strata, but is suitable for sound or vibration and compressive strength data. Such property data signals from each probe insert 80 are monitered and the readings from upper and lower probe means 54B and 52B then matched to the known properties of the upper and underlying strata respectively by adjusting the digging depth of the excavator 100.

FIG. 5 shows a third alternate arrangement wherein the combined probe means 52/4C, positioned in the gaps between digging wheel 10 portions, comprise inserts 80 in closely spaced pairs arrayed vertically so that the lowermost inserts 80 penetrate slightly below the plane 70 cut by moldboard blade 60 into the underlying material 92. The uppermost probe inserts 80 are placed above the surface 70 cut by digging wheel 10 and the moldboard blade 60 and contact the undisturbed material 90' left between portions of digging wheel 10. This arrangement is adaptable to measuring any of the aforementioned property data. When working with resistivity the digging depth is adjusted to keep the measured resistivity value in between the known strata values. When both vertically arrayed inserts 80 penetrate the same formation, the indication is for the known resistivity value of that stratum and an appropriate grade correction is made. When working with sound, vibration or compressive strength, digging depth control is the same with this arrangement as it is for that of FIG. 4.

Figure 6:
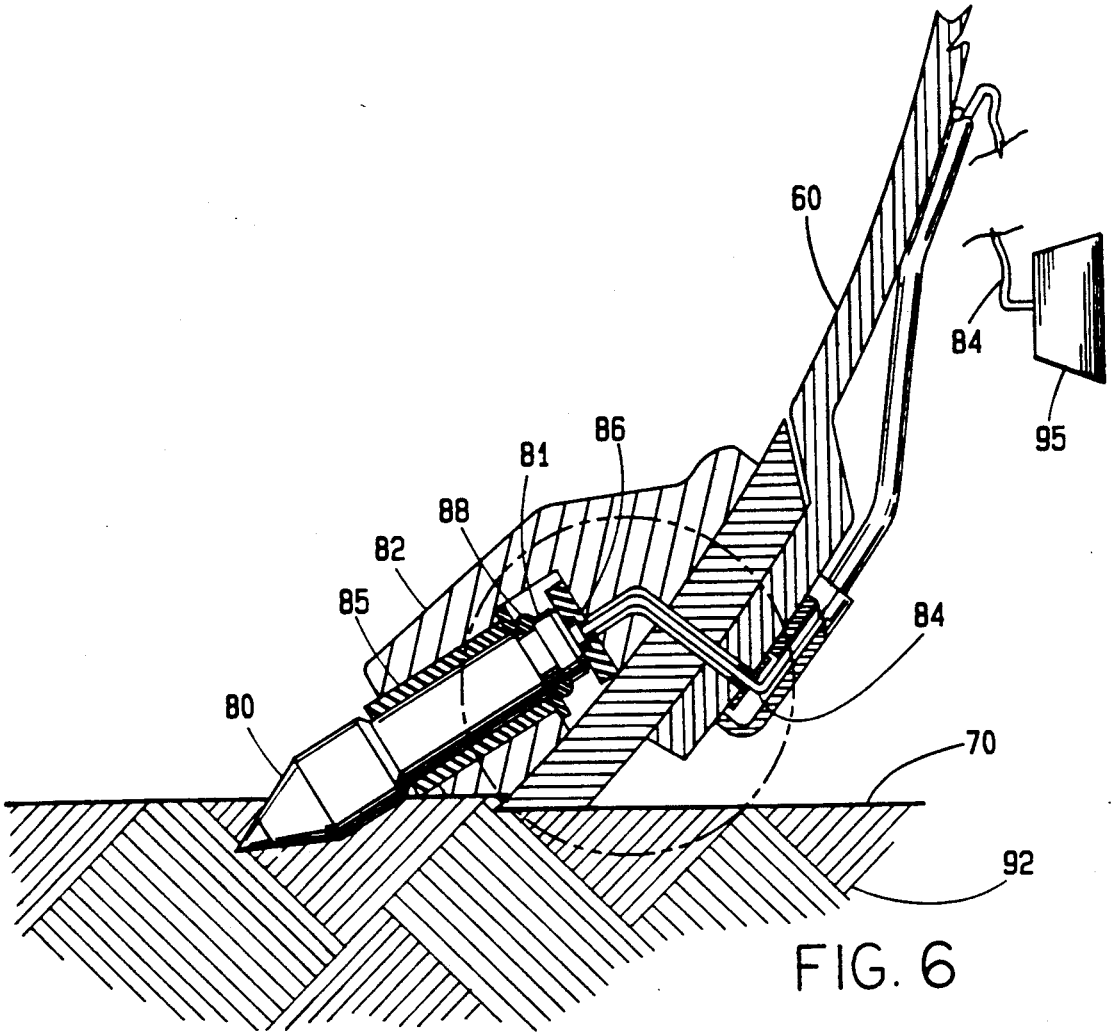
FIG. 6 is a detailed cross section view of a probe.

Caride tipped replaceable rock bits of a standard type such as the No. 1-93 by THE BOWDIL CO. of Canton, Ohio are preferred as replaceable probe inserts 80. FIG. 6 shows such an insert 80 mounted by means of a high strength plastic bushing 85 in socket 82, made so that the shank end 81 of the insert 80 is isolated mechanically and electrically from socket 82. The shank 81 of insert 80 is thus protected and accessible for contact with a pick-up means 86. By in this manner, direct contact of insert 80 with the material being excavated allows property data signals to be sensed by pick-up means 86 and transmitted by insulated wire 84 to remote measurement and display means 95. The insert 80 is held in place and urged against pick-up means 86 by retainer 88 and the housing 82 is mounted to the moldboard blade 60 by means of bolts (not shown), thus providing access for replacement of parts. Upper probe means 54A, 54B and 54C are functionally identical to lower probe means 52A, 52B and 52C respectively, differing only in shape and position.

The remote measurement and display means 95 is adapted to display the readings from the lower probe means 52 and the upper probe means 54 side-by-side for comparison, as on a split screen CRT, so that any required digging depth adjustment is readily apparant to the operator.

Figure 7:
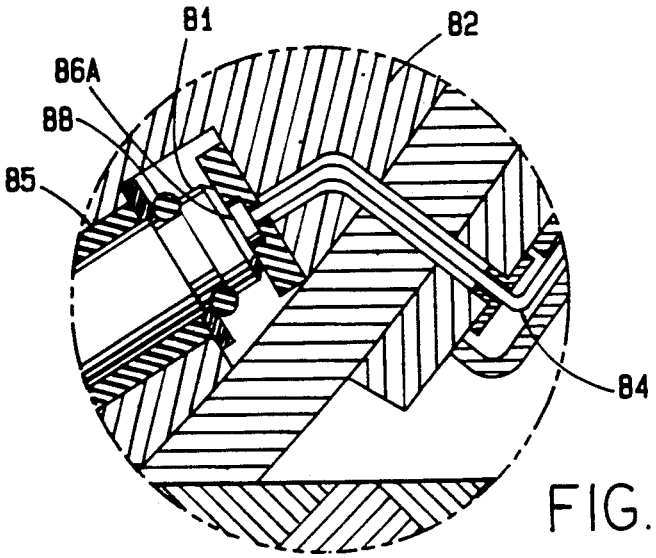
FIG. 7 is an enlarged detail view of that portion of the cross section of FIG. 6 showing the electrical contact pick-up means.
Figure 8:
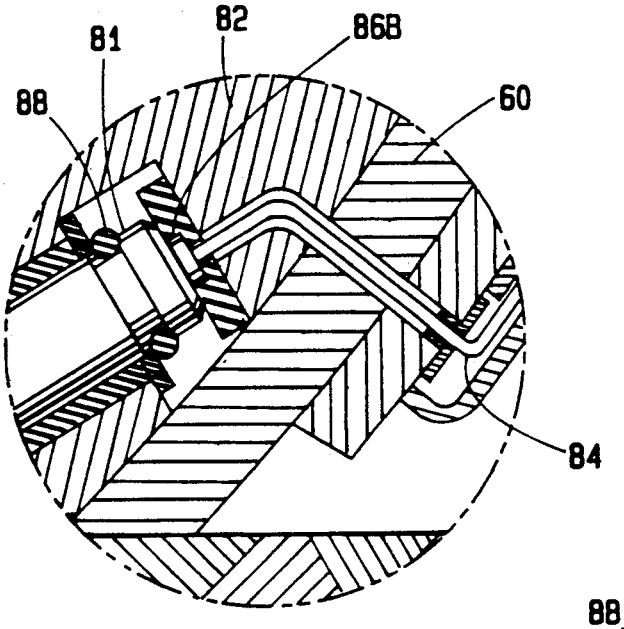
FIG. 8 is an enlarged detail view of that portion of the cross section of FIG. 6 showing the piezoelectric pick-up means.
Figure 9:
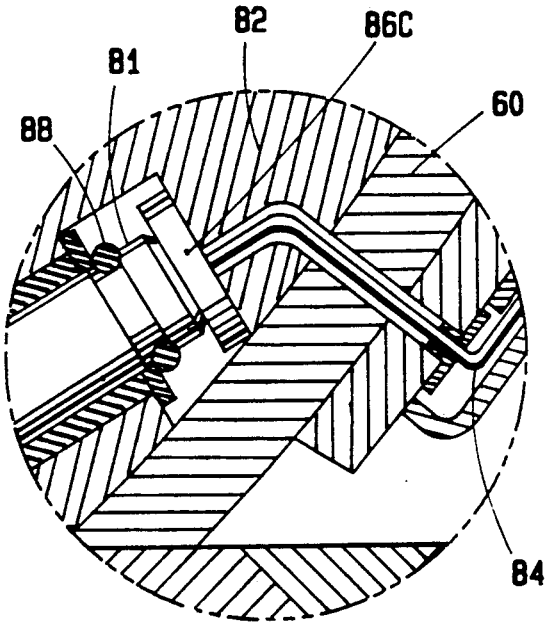
FIG. 9 is an enlarged detail view of that portion of the cross section of FIG. 6 showing the microphonic pick-up means.

FIGS. 7-9 are enlarged views of the circular area D designated in FIG. 6, showing alternate forms of pickup means 86 comprising an electrical contact 86A as shown in FIG. 7, a microphonic device 86B as shown in FIG. 8 and a piezoelectric device 86C as shown in FIG. 9. The electrical contacts 86A are pick-up means suitable for evaluation of electrical properties, such as resistivity or capacivity of a material, the microphonic device 86B for evaluation of the penetration sound or vibratory "signature" of materials, and the piezoelectric device 86C for evaluation of the penetration force, hence compressive strength of a material.

Figure 10:
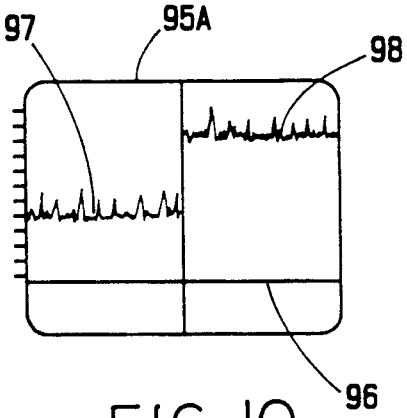
FIG. 10 shows the display of resistivity as seen by the excavator operator when digging coal with the probe means mounted on the moldboard assembly as shown in FIG. 2.

FIG. 10 shows the measurement and display means 98A, a split screen CRT, showing a value base line 96. Lower probe means 52A transmit data signals to be measured and displayed on the left hand side of the screen of 95A as resistivity trace 97, in this case having an intermediate value typical of sandstone parting materials. Upper probe means 54A transmit data signals to be measured and displayed on the right hand side of the screen of measurement and display means 95A as resistivity trace 98, which shows a significantly higher value typical of lignite.

So long as the values displayed by trace lines 97 and 98 remain as shown, the excavator 100 is taking the full depth of the lignite stratum with minimal intrusion into the underlying sandstone.

As an example of the operation of the preferred embodiment of the invention, the excavator 100 is set to dig on a descending grade, making an increasingly deeper cut, until the outermost, lower probe means 52A register a changing of resistance to a different value from that registered by the upper probe means 54A. The grade is then reduced and corrected until the resistance values are stabilized, with the lower and upper means penetrating the different strata, and picking up distinctly different resistance readings. From then on, whenever the lower and upper resistance readings become similar the value will indicate whether a positive or negative grade correction is needed. The procedure is virtually the same whether mining product or removing parting material except for a reversal of the grade correction response. A machine operator will soon become skilled in responding to these indications, or if desired, a grade control response sequence can be programmed for computerized stratum boundary excavation.

Figure 11:
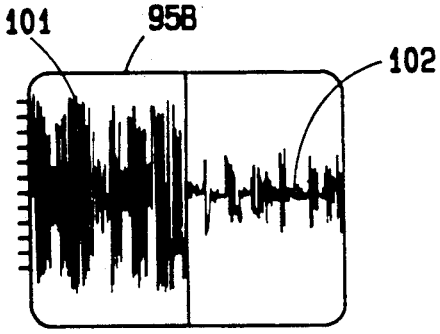
FIG. 11 shows the display of bit vibration or sound as seen by the excavator operator when digging at the lower boundary of a seam of coal with the probe means mounted on the moldboard assembly as shown in FIG. 2.

The depth control technique is much the same regardless of the material property used to distinguish the stratum boundary. FIG. 11 shows the split screen measurement and display means 98B. Lower probe means 52B, with microphonic pick-up means 86B, send noise and vibration signals to be measured and displayed on the left hand side of the screen of measurement and display means 95B as vibratory trace 101, the frequency and intensity of which are characteristic of abrasive sandstone. Upper probe means 54A send noise and vibration signals to be measured and displayed on the right hand side of the screen of measurement and display means 95B as vibratory trace 102, the frequency and intensity of which (showing a significantly reduced amplitude and frequency), are characteristic of coal. Amplitude of these traces relates roughly to the material hardness while frequency relates roughly to the abrasive characteristic of the material. Again, so long as trace lines 101 and 102 remain as shown, the full depth of the coal stratum is being excavated with minimal intrusion into the underlying sandstone.

Figure 12:
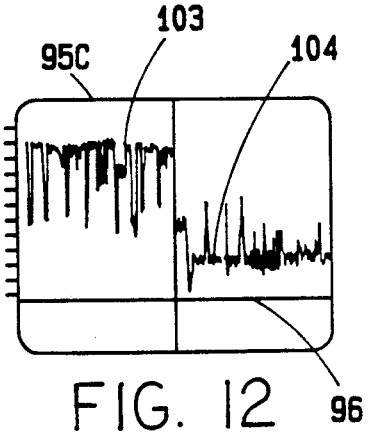
FIG. 12 shows the display of compressive strength as seen by the excavator operator when digging at the lower boundary of a seam of coal with the probe means mounted on the moldboard assembly as shown in FIG. 2.

FIG. 12 shows the split screen measurement and display means 95C, again showing a value base line 96. Lower probe means 52C, with piezoelectric pick-up means 86C, transmit data signals to be measured and displayed on the left hand side of the screen of measurement and display means 95C as compressive strength trace 103, in this case having a rather high value typical of sandstone parting materials. Upper probe means 54C transmit data signals to be measured and displayed on the right hand side of the screen of measurement and display means 95C as compressive strength trace 104, which shows a significantly lower value typical of coal.

So long as the values displayed by trace lines 103 and 104 remain as shown, the excavator 100 is taking the full depth of the coal stratum with minimal intrusion into the underlying sandstone.

It will be understood that the invention is not limited to the disclosed embodiments, but is capable of rearrangement, modification, and substitution of parts and elements without departing from the spirit of the invention.

I claim:

1. A stratum boundary sensing apparatus for a continuous excavator comprising:

sectional rotary cutting means for excavating stratified material;

moldboard means following said rotary cutting means for cleaning the surface cut by said rotary cutting means;

first probe means mounted on said moldboard means and positioned to penetrate undisturbed material below the surface cut by said rotary cutting means;

second probe means mounted on said moldboard means and positioned to penetrate undisturbed material above the surface cut by said rotary cutting means;

pick-up means for acquiring characteristic material property data signals from said probe means;

transmission means for transmitting said characteristic material property data signals from said pick-up means, and;

receiving and measuring means for evaluating said characteristic material property data signals.

2. A stratum boundary sensing apparatus for a continuous excavator according to claim 1 wherein said each probe means comprises:

one or more removable inserts mounted for penetration of undisturbed materials, and;

mounting means for mounting said removable inserts on said excavator to cooperate with said pick-up means.

3. A stratum boundary sensing apparatus for a continuous excavator according to claim 2 wherein the characteristic property evaluated is compressive strength.

4. A stratum boundary sensing apparatus for a continuous excavator according to claim 2 wherein the characteristic property evaluated is the vibratory signature.

5. A stratum boundary sensing apparatus for a continuous excavator according to claim 2 wherein the characteristic property evaluated is resistivity.

6. A stratum boundary sensing apparatus for a continuous excavator according to claim 2 wherein the characteristic property evaluated is capacitivity.

7. A stratum boundary sensing apparatus for a continuous excavator according to claim 1 wherein said receiving and measuring means comprises:

first receiving and measuring means for evaluating the characteristic material property data signals of strata penetrated by said first probe means, and;

second receiving and measuring means for evaluating the characteristic material property data signals of strata penetrated by said second probe means.

8. A stratum boundary sensing apparatus for a continuous excavator according to claim 7 wherein the characteristic property evaluated is compressive strength.

9. A stratum boundary sensing apparatus for a continuous excavator according to claim 7 wherein the characteristic property evaluated is the vibratory signature.

10. A stratum boundary sensing apparatus for a continuous excavator according to claim 7 wherein the characteristic property evaluated is resistivity.

11. A stratum boundary sensing apparatus for a continuous excavator according to claim 7 wherein the characteristic property evaluated is capacitivity.

12. A stratum boundary sensing apparatus for a continuous excavator according to claim 1 wherein the characteristic property evaluated is compressive strength.

13. A stratum boundary sensing apparatus for a continuous excavator according to claim 1 wherein the characteristic property evaluated is the vibratory signature.

14. A stratum boundary sensing apparatus for a continuous excavator according to claim 1 wherein the characteristic property evaluated is resistivity.

15. A stratum boundary sensing apparatus for a continuous excavator according to claim 1 wherein the characteristic property evaluated is capacitivity.

16. A method for controlling the digging depth of a continuous excavator in a formation having at least two strata so as to fully excavate the upper stratum with minimal penetration of the underlying stratum comprising;

determining a characteristic property of strata materials;

advancing said excavator;

increasing the digging depth of said excavator;

penetrating said formation at the forward advance rate of excavation with upper probe means located on said excavator above the digging depth thereof;

simultaneously penetrating said formation at the forward advance rate of excavation with lower probe means located on said excavator below the digging depth thereof;

evaluating the characteristic property of the materials penetrated by both said upper and lower probe means, and;

adjusting the digging depth of said excavator so that the characteristic property value of the materials penetrated by said upper and lower probe means is maintained in agreement with the known characteristic property values for said upper stratum and said underlying stratum materials respectively.

17. A method for controlling the cutting depth of a continuous excavator according to claim 16 wherein the characteristic property evaluated is compressive strength.

18. A method for controlling the cutting depth of a continuous excavator according to claim 16 wherein the characteristic property evaluated is the vibratory signature.

19. A method for controlling the cutting depth of a continuous excavator according to claim 16 wherein the characteristic property evaluated is resistivity.

20. A method for controlling the cutting depth of a continuous excavator according to claim 16 wherein the characteristic property evaluated is capacitivity.

* * * * *